US010354628B2

(12) United States Patent
Watanabe

(10) Patent No.: US 10,354,628 B2
(45) Date of Patent: Jul. 16, 2019

(54) AUTOMATIC ARRANGEMENT OF MUSIC PIECE WITH ACCENT POSITIONS TAKEN INTO CONSIDERATION

(71) Applicant: YAMAHA CORPORATION, Hamamatsu-shi (JP)

(72) Inventor: Daichi Watanabe, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 82 days.

(21) Appl. No.: 15/262,548

(22) Filed: Sep. 12, 2016

(65) Prior Publication Data

US 2017/0084259 A1 Mar. 23, 2017

(30) Foreign Application Priority Data

Sep. 18, 2015 (JP) ..... 2015-185299

(51) Int. Cl.
*G10H 1/36* (2006.01)
*G10H 1/40* (2006.01)
*G10H 1/00* (2006.01)

(52) U.S. Cl.
CPC ..... *G10H 1/0025* (2013.01); *G10H 1/40* (2013.01); *G10H 2210/051* (2013.01); (Continued)

(58) Field of Classification Search
USPC ..... 84/611
See application file for complete search history.

(56) References Cited

U.S. PATENT DOCUMENTS 5,491,298 A 2/1996 Eiichiro
5,525,749 A 6/1996 Aoki
(Continued)

FOREIGN PATENT DOCUMENTS

JP 2005202204 A 7/2005
JP 2012203216 A 10/2012

OTHER PUBLICATIONS

Notice of Allowance issued in U.S. Appl. No. 15/262,625 dated Apr. 10, 2017.

(Continued)

*Primary Examiner* — Christopher Uhlir
(74) *Attorney, Agent, or Firm* — Rossi, Kimms & McDowell LLP

(57) ABSTRACT

Arranged accompaniment data are created by: acquiring original performance information; extracting, from the acquired original performance information, one or more accent positions in a music piece represented by the acquired original performance information; acquiring existing accompaniment pattern data; and adjusting time positions of one or more accompaniment notes, which are to be generated on the basis of the acquired accompaniment pattern data, so as to coincide with the extracted one or more accent positions. In this way, it is possible to create accompaniment data matching accent positions (rhythmic elements) of the music piece represented by the original performance information and thereby automatically make a musical arrangement with respective characteristics of the existing accompaniment pattern data and original performance information remaining therein.

16 Claims, 7 Drawing Sheets

(52) U.S. Cl.
CPC .. *G10H 2210/086* (2013.01); *G10H 2210/111* (2013.01); *G10H 2210/145* (2013.01)

(56) References Cited

U.S. PATENT DOCUMENTS 6,294,720 B1 * 9/2001 Aoki ..... G10H 1/42 84/611
7,432,436 B2 * 10/2008 Ito ..... G10H 1/28 84/636
7,525,036 B2 4/2009 Shotwell et al.
7,584,218 B2 9/2009 Miyajima et al.
8,239,052 B2 * 8/2012 Itoyama ..... G10H 1/0008 700/94
8,338,686 B2 * 12/2012 Mann ..... G06F 3/0481 84/609
9,251,773 B2 * 2/2016 Buskies ..... G10H 1/0066
2013/0305907 A1 11/2013 Kakishita
2015/0013527 A1 1/2015 Buskies et al.
2015/0013528 A1 1/2015 Buskies et al.

OTHER PUBLICATIONS

Copending U.S. Appl. No. 15/262,625, filed Sep. 12, 2016 (a copy is not included because the cited application is not yet available to the public and the Examiner has ready access to the cited application).
Office Action issued in U.S. Appl. No. 15/262,625 dated Dec. 15, 2016.
Copending U.S. Appl. No. 15/262,594, filed Sep. 12, 2016 (a copy is not included because the cited application is not yet available to the public and the Examiner has ready access to the cited application).
Office Action issued in U.S. Appl. No. 15/262,594 dated Aug. 16, 2018.

* cited by examiner

RHYTHM IMAGE OF ORIGINAL PERFORMANCE INFO.

EXAMPLE RESULT OF ACCENT POSITION EXTRACTION (THRESHOLD VALUE OF NUMBER OF NOTES =3)

| MEASURE NO. | BEAT NO. | POSITIONAL DIFFERENCE | NUMBER OF TONES | LENGTH | ACCENT |
|---|---|---|---|---|---|
| 1 | 3 | 0 | 4 | DOTTED QUARTER NOTE | A |
| 1 | 4 | 240 | 3 | EIGHTH NOTE + QUARTER NOTE | A |
| 2 | 2 | 0 | 1 | QUARTER NOTE | — |
| 2 | 3 | 0 | 1 | QUARTER NOTE | — |
| 2 | 4 | 0 | 1 | QUARTER NOTE | — |

ACCOMPA. PATTERN DATA (TEMPLATE)

PITCH SHIFT ACCORDING TO CHORD INFO.

ADJUSTMENT ACCORDING TO ACCENT POSITIONS

RHYTHM IMAGE OF ORIGINAL PERFORMANCE INFO.

EXAMPLE RESULT OF ACCENT POSITION EXTRACTION (THRESHOLD VALUE OF NUMBER OF NOTES =3)

| MEASURE NO. | BEAT NO. | POSITIONAL DIFFERENCE | NUMBER OF TONES | LENGTH | ACCENT |
|---|---|---|---|---|---|
| 1 | 1 | 0 | 4 | QUARTER NOTE | A |
| 1 | 2 | 0 | 2 | QUARTER NOTE | – |
| 1 | 3 | 0 | 4 | DOTTED EIGHTH NOTE | A |
| 1 | 3 | 360 | 2 | SIXTEENTH NOTE | — |
| 1 | 4 | 0 | 3 | QUARTER NOTE | A |
| 2 | 1 | 0 | 4 | QUARTER NOTE | A |
| 2 | 2 | 0 | 2 | QUARTER NOTE | – |
| 2 | 3 | 0 | 4 | DOTTED EIGHTH NOTE | A |
| 2 | 3 | 360 | 2 | SIXTEENTH NOTE | — |
| 2 | 4 | 0 | 3 | QUARTER NOTE | A |

AUTOMATIC ARRANGEMENT OF MUSIC PIECE WITH ACCENT POSITIONS TAKEN INTO CONSIDERATION

BACKGROUND

The present invention relates generally to techniques for automatically arranging music performance information and more particularly to a technique for making a good-quality automatic arrangement (musical arrangement) with accent positions of an original music piece taken into consideration.

Japanese Patent Application Laid-open Publication No. 2005-202204 (hereinafter referred to as "Patent Literature 1") discloses a technique in which a user selects a desired part (musical part) from MIDI-format automatic performance data of a plurality of parts (musical parts) of a given music piece and a musical score of a desired format is created for the user-selected part. According to a specific example disclosed in Patent Literature 1, the user selects a melody part, accompaniment data suitable for a melody of the selected melody part are automatically created, and then a musical score comprising the selected melody part and an accompaniment part based on the automatically-created accompaniment data is created. More specifically, as a way of automatically creating the accompaniment data suitable for the melody in the disclosed technique, a plurality of accompaniment patterns corresponding to different performance levels (i.e., levels of difficulty of performance) are prepared in advance, an accompaniment pattern that corresponds to a performance level selected by the user is selected from the prepared accompaniment patterns, and then accompaniment data are automatically created on the basis of the selected accompaniment pattern and with a chord progression in the melody taken into consideration.

It may be said that the automatic accompaniment data creation disclosed in Patent Literature 1 automatically makes an arrangement of the accompaniment on the basis of a given melody. However, the automatic accompaniment data creation disclosed in Patent Literature 1 is merely designed to change pitches of tones, constituting an existing accompaniment pattern (chord backing, arpeggio, or the like), in accordance with a chord progression of the melody; thus, it cannot make an accompaniment arrangement harmonious with a rhythmic element of the original music piece. Thus, because the accompaniment added by the automatic accompaniment is not harmonious with the rhythmic element of the original music piece, there would arise the inconvenience that accent positions originally possessed by the original music piece are canceled out. Further, if a performance of the accompaniment based on the accompaniment data automatically created as above is executed together with a melody performance of the original music piece, for example, on a keyboard musical instrument, the performance tends to become difficult due to disagreement or disharmony in accent position between the right hand (melody performance) and the left hand (accompaniment performance) of a human player.

SUMMARY OF THE INVENTION

In view of the foregoing prior art problems, it is an object of the present invention to provide an automatic arrangement apparatus and method capable of enhancing quality of an automatic arrangement.

In order to accomplish the above-mentioned object, the present invention provides an improved automatic arrangement apparatus comprising a processor that is configured to:

acquire original performance information; extract, from the acquired original performance information, one or more accent positions in a music piece represented by the original performance information; acquire existing accompaniment pattern data; and create arranged accompaniment data by adjusting time positions of one or more accompaniment notes, which are to be generated based on the acquired accompaniment pattern data, so as to coincide with the extracted one or more accent positions.

According to the present invention, for creating accompaniment data suitable for the original performance information (i.e., arranging the accompaniment pattern data to suit the original performance information), respective time positions of one or more accompaniment notes, which are to be sounded on the basis of the accompaniment pattern data, are adjusted so as to match or coincide with the one or more accent positions extracted from the original performance information. In this way, the present invention can create accompaniment data matching the accent positions (rhythmic elements) in the music piece represented by the original performance information; thus, the present invention can automatically make an arrangement (musical arrangement) with respective characteristics of the existing accompaniment pattern data and original performance information (original music piece) remaining therein. When an accompaniment based on the accompaniment data automatically created in the aforementioned manner is performed together with a melody performance of the original music piece, for example, on a keyboard musical instrument, a right hand performance (i.e., melody performance) and a left hand performance (i.e., accompaniment performance) by a human player can be executed with ease because the two performances can appropriately match each other in accent position (rhythmic element). As a result, the present invention can automatically provide a good-quality arrangement.

In one embodiment, in order to create the arranged accompaniment data, the processor is configured in such a manner (1) that, if the one or more accompaniment notes to be generated based on the acquired accompaniment pattern data include an accompaniment note present at a time position coinciding with one of the extracted accent positions, the processor includes, into the arranged accompaniment data, that accompaniment note present at the time position coinciding with one of the extracted accent positions, and (2) that, if the one or more accompaniment notes to be generated based on the acquired accompaniment pattern data do not include an accompaniment note present at a time position coinciding with one of the extracted accent positions, the processor shifts an accompaniment note present at a time position near the one extracted accent position over to another time position coinciding with the one extracted accent position and includes the shifted accompaniment note into the arranged accompaniment data. With such arrangements, the present invention can create accompaniment data matching the accent positions possessed by the original performance information.

In another embodiment, in order to create the arranged accompaniment data, the processor is configured in such a manner (1) that, if, of the one or more accompaniment notes to be generated based on the acquired accompaniment pattern data, any one accompaniment note located at a finer time position than a predetermined note resolution coincides with one of the extracted accent positions, the processor includes, into the arranged accompaniment data, the one accompaniment note located at the finer time position, and (2) that, if, of the one or more accompaniment notes to be generated based on the acquired accompaniment pattern data, any one accompaniment note located at a finer time position than the predetermined note resolution coincides with none of the extracted accent positions, the processors does not include, into the arranged accompaniment data, the one accompaniment note located at the finer time position. With the feature of (1) above, the present invention can create accompaniment data matching the accent positions (rhythmic elements) in the music piece represented by the original performance information in a similar manner to the aforementioned. Also, with the feature of (2) above, each accompaniment note of a finer resolution than the predetermined note resolution is omitted from the arranged accompaniment data unless it coincides with any one of the accent positions.

The automatic arrangement apparatus of the present invention may be constructed of a dedicated apparatus or circuitry configured to perform necessary functions, or by a combination of program modules configured to perform their respective functions and a processor (e.g., a general-purpose processor like a CPU, or a dedicated processor like a DSP) capable of executing the program modules.

The present invention may be constructed and implemented not only as the apparatus invention discussed above but also as a computer-implemented method invention comprising steps of performing various functions. Also, the present invention may be implemented as a program invention comprising a group of instructions executable by a processor configured to perform the method. In addition, the present invention may be implemented as a non-transitory computer-readable storage medium storing the program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

Certain preferred embodiments of the present invention will hereinafter be described in detail, by way of example only, with reference to the accompanying drawings, in which:

FIGS. 3A and 3B are diagrams showing example results of accent position extraction performed, as a first specific embodiment of the processing, with regard to first and second measures in given original performance information, of which FIG. 3A is a diagram showing an example of a rhythm image of the first and second measures in the given original performance information and FIG. 3B is a table showing a result of accent position extraction from the original performance information having the rhythm image shown in FIG. 3A;

FIGS. 4A to 4C are diagrams showing actual examples pertaining to the first embodiment of the processing, of which FIG. 4A shows a musical score representative of an example of acquired accompaniment pattern data (template), FIG. 4B shows a musical score representative of an example where accompaniment notes to be generated on the basis of the accompaniment pattern data of FIG. 4A have been shifted in pitch in accordance with acquired chord information, and FIG. 4C shows an example where the accompaniment notes shown in FIG. 4B have been adjusted in accent position in accordance with the result of the accent position extraction shown in FIG. 3B;

FIGS. 6A and 6B are diagrams showing example results of accent position extraction performed, as a second specific embodiment of the processing, with regard to first and second measures in other given original performance information, of which FIG. 6A is a diagram showing an example of a rhythm image of the first and second measures in the given original performance information and FIG. 6B is a table showing a result of accent position extraction from the original performance information having the rhythm image shown in FIG. 6A;

FIGS. 7A to 7C are diagrams showing actual examples pertaining to the second embodiment of the processing, of which FIG. 7A shows a musical score representative of an example of acquired accompaniment pattern data (template), FIG. 7B shows a musical score representative of an example where accompaniment notes to be generated on the basis of the accompaniment pattern data of FIG. 7A have been shifted in pitch in accordance with acquired chord information, and FIG. 7C shows a musical score representative of an example where the accompaniment notes shown in FIG. 7B have been adjusted in accent position in accordance with the result of the accent position extraction shown in FIG. 3B.

DETAILED DESCRIPTION

Figure 1:
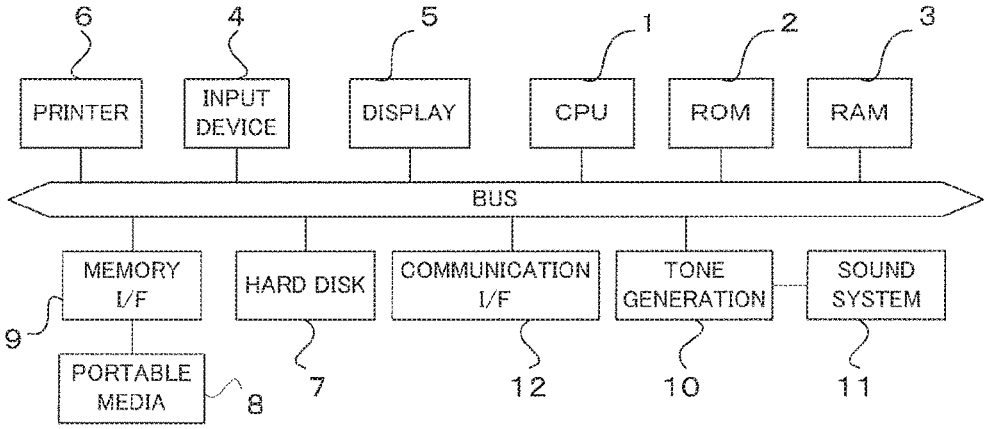
FIG. 1 is a hardware setup block diagram showing an embodiment of an automatic arrangement apparatus of the present invention.

FIG. 1 is a hardware setup block diagram showing an embodiment of an automatic arrangement apparatus of the present invention. The embodiment of the automatic arrangement apparatus need not necessarily be constructed as an apparatus dedicated to automatic arrangement and may be any desired apparatus or equipment with computer functions, such as a personal computer, portable terminal apparatus or electronic musical instrument, and which has installed therein an automatically-arranging application program of the present invention. The embodiment of the automatic arrangement apparatus has a hardware construction well known in the art of computers, which comprises for example among other things: a CPU (Central Processing Unit) 1; a ROM (Read-Only Memory) 2; a RAM (Random Access Memory) 3; an input device 4 including a keyboard and mouse for inputting characters (letters and symbols), signs, etc.; a display 5; a printer 6; a hard disk 7 that is a non-volatile large-capacity memory; a memory interface (I/F) 9 for portable media 8, such as a USB memory; a tone generator circuit board 10; a sound system 11, such as a speaker; and a communication interface (I/F) 12 for connection to external communication networks. The automatically-arranging application program of the present invention, other application programs and control programs are stored in a non-transitory manner in the ROM 2 and/or the hard disk 7.

Figure 2:
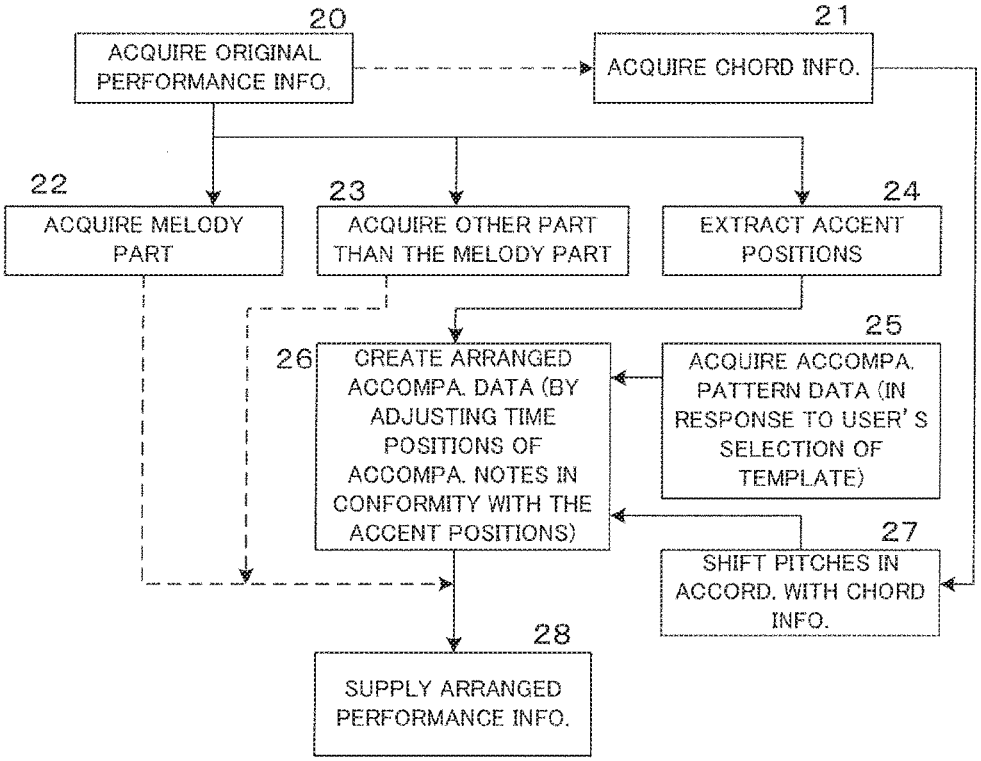
FIG. 2 is a functional block diagram explanatory of an embodiment of processing of the present invention performed under the control of a CPU shown in FIG. 1.

FIG. 2 is a functional block diagram explanatory of an embodiment of processing performed under the control of the CPU 1 shown in FIG. 1. First, music performance information (hereinafter referred to also as "original performance information") that becomes an object of arrangement is acquired in block 20. Any desired specific construction may be employed for acquiring the original performance information. For example, the original performance information to be acquired may be of any desired data format, such as one comprising data encoded in a predetermined format like a standard MIDI file (SMF), one comprising image information of a musical score written on a five-line musical staff or one comprising audible audio waveform data, as long as the original performance information can represent a music piece. When original performance information comprising a musical score image has been acquired, for example, the musical score image is analyzed in accordance with a conventionally-known musical score analysis technique, then pitches, beat positions (time positions), note values, etc. of individual notes constituting the original performance information are encoded, and then various symbols and marks, such as dynamic and accent marks, associated with the notes are encoded together with respective time positions. When original performance information comprising audio waveform data has been acquired too, it is only necessary that the audio waveform data be analyzed in accordance with conventionally-known techniques for analyzing tone pitches, volumes, etc., then pitches, beat positions (time positions), note values, etc. of individual notes constituting the original performance information be encoded, and then tone volumes be encoded together with respective time positions. Further, the original performance information to be acquired may comprise, as a musical part construction, any one or more desired substantive musical parts, such as: a melody part alone; a right hand part (melody part) and a left hand part (accompaniment or chord part) as in a piano score; a melody part and a chord backing part; or a plurality of accompaniment parts like an arpeggio part and rhythm (drum) part. In the case where the original performance information to be acquired comprises a melody part alone, for example, an arrangement can be made, in accordance with the basic principles of the present invention, to add performance information of an accompaniment part. In the case where the original performance information to be acquired comprises a melody part and an accompaniment part, an arrangement can be made, in accordance with the basic principles of the present invention, to provide accompaniment performance information (e.g., simplified for beginner human players or complicated for advanced human players) different from original accompaniment performance information of the accompaniment part possessed by the original performance information. Further, a construction or path for acquiring desired original performance information may be chosen as desired. For example, desired original performance information may be acquired via the memory I/F 9 from the portable medium 8 having that desired original performance information stored therein, or may be selectively acquired via the communication I/F 12 from an external source or server. When the CPU 1 performs the process of block 20, its functions as a means for acquiring original performance information.

In block 21, chord information is acquired which is indicative of a chord progression in the music piece represented by the acquired original performance information. If any chord information is included in the acquired original performance information, that chord information may be acquired. If no chord information is included in the acquired original performance information, on the other hand, a chord may be detected by analyzing a melody progression, included in the acquired original performance information, using a conventionally-known chord analysis technique, and chord information may be acquired on the basis of the chord detection. Alternatively, a user may input chord information via the input device 4 or the like, and chord information may be acquired on the basis of the user's input. In subsequent creation of harmony-generating accompaniment data, the thus-acquired chord information is used for shifting pitches of accompaniment notes indicated by the accompaniment data.

In blocks 22 and 23, a melody part and other part (if any) than the melody part are separated from the acquired original performance information, to acquire original performance information of the melody part (block 22) and original performance information of the other part (if any) (block 23). Note that, if the original performance information acquired in block 20 includes part information or identification information similar to the part information, part-specific original performance information may be acquired by use of such part information or identification information. Further, in the case where the original performance information comprises a musical score image and if the musical score comprises a melody score (G or treble clef score) and an accompaniment score (F or bass cleft score) as in a piano score or if the musical score comprises part-specific musical staffs, part-specific original performance information can be acquired on the basis of such musical scores or musical staffs. If the musical score does not comprise part-specific musical staffs, notes of individual parts, such as a melody part, chord part and bass part, may be extracted presumptively through analysis of the musical scores.

In block 24, one or more accent positions in the music piece represented by the acquired original performance information are extracted on the basis of the acquired original performance information. In this case, accent positions of the music piece may be extracted from a combination of all of the parts included in the original performance information, or accent positions of the music piece may be extracted from one or some of the parts included in the original performance information. For example, arrangements may be made to allow the user to select from which of the parts accent positions should be extracted. Note that such accent position extraction is performed across the entire music piece (or across one chorus) and one or more accent positions extracted are identified (stored) in association with a temporal or time progression of the original performance information. When the CPU 1 performs the process of block 24, it functions as a means for extracting one or more accent positions in the music piece represented by the acquired original performance information.

A technique (algorithm) for specifically extracting accent positions in the instant embodiment is not limited to a particular technique (algorithm) and may be any desired one as along as it can extract accent positions in accordance with some criteria. Examples of such a technique (algorithm) for extracting accent positions are given in (1) to (7) below. Any one, or a combination of two or more of, such example techniques (algorithms) may be employed.

(1) In the case where the original performance information includes a chord part, the number of notes to be sounded simultaneously per tone generation timing (sounding timing) in the chord part (or in the chord part and melody part) is obtained or determined, and each tone generation timing (i.e., time position or beat position) where the number of notes to be sounded simultaneously is equal to and greater a predetermined threshold value is extracted as an accent position. Namely, this technique takes into consideration the characteristic that, particularly in a piano performance or the like, the number of notes to be simultaneously performed is greater in a portion of the performance that is to be emphasized more; that is, the more the portion of the performance is to be emphasized, the greater is the number of notes to be simultaneously performed.

(2) In a case where any accent mark is present in the original performance information, a tone generation timing (time position) at which the accent mark is present is extracted as an accent position.

(3) In the case where the original performance information is a MIDI file, the tone generation timing (time position) of each note event whose velocity value is equal to or greater than a predetermined threshold value is extracted as an accent position.

(4) Accent positions are extracted with positions of notes in a phrase in the original performance information (e.g., melody) taken into consideration. For example, the tone generation timings (time positions) of the first note and/or the last note in the phrase are extracted as accent positions, because the first note and/or the last note are considered to have a strong accent. Further, the tone generation timings (time positions) of a highest-pitch and/or lowest-pitch note in a phrase are extracted as accent positions, because the highest-pitch and lowest-pitch note are considered to have a strong accent. Note that the music piece represented by the original performance information comprises a plurality of portions and the above-mentioned "phrase" is any one or more of such portions in the music piece.

(5) A note whose pitch changes from a pitch of a preceding note greatly, by a predetermined threshold value or more, to a higher pitch or lower pitch in a temporal pitch progression (such as a melody progression) in the original performance information is considered to have a strong accent, and thus the tone generation timing (time position) of such a note is extracted as an accent position.

(6) Individual notes of a melody (or accompaniment) in the original performance information are weighted in consideration of their beat positions in a measure (i.e., bar), and the tone generation timing (time position) of each note of which the weighted value is equal to or greater than a predetermined threshold value is extracted as an accent position. For example, the greatest weight value is given to the note at the first beat in the measure, the second greatest weight is given to each on-beat note at or subsequent to the second beat, and a weight corresponding to a note value is given to each off-beat note (e.g., the third greatest weight is given to an eighth note, and the fourth greatest weight is given to a sixteenth note).

(7) Note values or durations of individual notes in a melody (or accompaniment) in the original performance information are weighted, and the tone generation timing (time position) of each note whose weighted value is equal to or greater than a predetermined value is extracted as an accent position. Namely, a note having a long tone generating time is regarded as having a stronger accent than a note having a shorter tone generating time.

Further, in block 25, existing accompaniment pattern data (i.e., accompaniment pattern data obtained or prepared in advance) is acquired. Namely, a multiplicity of existing accompaniment pattern data (templates) are prestored in an internal database (e.g., hard disk 7 or portable medium 8) or in an external database (e.g., a server on the Internet), and the user selects a desired one of the accompaniment pattern data (templates) from the database in view of a time, rhythm, etc. of the music piece of the original performance information that is to be arranged. In response to such a user's selection, the desired accompaniment pattern data (template) is acquired in block 25. Note that the same accompaniment pattern data need not necessarily selected (acquired) for the entire music piece of the original performance information, and different accompaniment pattern data may be selected (acquired) for different portions, each comprising some measures, of the music piece. As another alternative, a combination of a plurality of different types of accompaniment pattern data (e.g., chord backing pattern and drum rhythm pattern) may be selected (acquired) simultaneously. When the CPU 1 performs the process of block 25, it functions as a means for acquiring existing accompaniment pattern data.

Note that, in one embodiment, a conventionally-known accompaniment style data (automatic accompaniment data) bank may be used as a source of existing accompaniment pattern data. In such a conventionally-known accompaniment style data (automatic accompaniment data) bank, a plurality of sets of accompaniment style data are stored for each of various categories (such Pop & Rock, Country & Blues and Standard & Jazz). Each of the sets of accompaniment style data includes an accompaniment data set per section, such as an intro section, main section, fill-in section or ending section. The accompaniment data set of each of the sections includes accompaniment pattern data (templates) of a plurality of parts, such as rhythm 1, rhythm 2, bass, rhythmic chord 1, rhythmic chord 2 , phrase 1 and phrase 2. The part-specific accompaniment pattern data (templates) in the lowermost layer of the conventionally-known accompaniment style data (automatic accompaniment data) bank are the accompaniment pattern data acquired in block 25 above. In block 25 above, accompaniment pattern data of only one part may be acquired from among accompaniment data sets of a given section, or alternatively a combination of accompaniment pattern data of all or some of the parts may be acquired. As conventionally known in the art, information indicative of a reference chord name (e.g., C major chord), information defining pitch conversion rules, etc. is additionally included in the accompaniment pattern data of parts including pitch elements, such as rhythmic chord 1, rhythmic chord 2, phrase 1 and phrase 2. The substance of the accompaniment pattern data (template) may be either data encoded distributively in accordance with the MIDI standard or the like, or data recorded along the time axis, such as audio waveform data.

In next block 26, data of accompaniment notes (accompaniment data) are created on the basis of the accompaniment pattern data acquired in block 25 above, at which time arranged accompaniment data are created by adjusting the time positions (tone generation timings) of one or more accompaniment notes, which are to be generated on the basis of the accompaniment pattern data, so as to coincide with (or in conformity with) the one or more accent positions extracted in block 24 above. For example, in the instant embodiment, accompaniment data of a desired section or portion of the music piece are created by placing, in the desired portion of the music piece, accompaniment pattern data (template), having one or more measures, once or repeatedly a plurality of times, and arranged accompaniment data are created by changing the time positions (tone generation timings) of one or more accompaniment notes in the desired portion in conformity with the extracted one or more accent positions. When the CPU 1 performs the process of block 26, it functions as a means for creating arranged accompaniment data by adjusting the time positions of one or more accompaniment notes, which are to be generated based on the acquired accompaniment pattern data, so as to coincide with the extracted one or more accent positions.

Further, in block 27, a process is performed in the case where the accompaniment pattern data (template) acquired in block 25 above includes accompaniment notes having pitch elements, such as those of a chord backing or arpeggio. More specifically, when arranged accompaniment data are created in block 26 above, the process of block 27 shifts pitches of accompaniment data, which are to be created, in accordance with the chord information acquired in block 21. Note, however, that, in the case where the accompaniment pattern data (template) acquired in block 25 comprises a drum rhythm pattern, the process of block 27 is omitted.

At next block 28, arranged performance information including the arranged accompaniment data created in block 26 above is supplied to the user. A particular form in which the arranged performance information is to be supplied to the user may be selected as desired as a matter of design choice. For example, only the arranged accompaniment data created in block 26 above may be supplied as electronic data encoded in a predetermined form, such as the MIDI standard, or visually displayed as a specific musical score image on the display 5, or printed out on a sheet of paper via the printer 6, or supplied as electronic image data. As another example, the original performance information of at least one of the melody part and other part (if any) of the acquired original performance information, separated in blocks 22 and 23 above, is selected as appropriate (e.g., in accordance with a user's desire), and the thus-selected original performance information of the at least one part is synthesized with the arranged accompaniment data created in block 26 to thereby provide arranged performance information. The thus-synthesized arranged performance information may be supplied as encoded electronic data or physical or electronic musical score image data.

<First Embodiment>

Hereinafter, a first specific example of the process in block 26 above will be described as a first embodiment of the accompaniment data creation process. According to the first embodiment, 1) if the one or more accompaniment notes to be generated on the basis of the acquired accompaniment pattern data include an accompaniment note present at a time position coinciding with any one of the extracted accent positions, the accompaniment data creation process in block 26 includes, into the arranged accompaniment data, that accompaniment note present at the time position coinciding with one of the extracted accent positions. 2) If the one or more accompaniment notes to be generated on the basis of the acquired accompaniment pattern data does not include an accompaniment note present at a time position coinciding with one of the extracted accent positions, on the other hand, the accompaniment data creation process in block 26 shifts an accompaniment note present at a time position near the one extracted accent position over to another time position coinciding with the one extracted accent position and then includes the thus-shifted accompaniment note into the arranged accompaniment data. In this way, it is possible to create accompaniment data coinciding with an accent position possessed by the original performance information. For example, an example of an accompaniment note generated in accordance with item 1) above is an accompaniment note at tone generation timing A3 in later-described FIG. 4C, and an example of an accompaniment note generated in accordance with item 2) above is an accompaniment note at tone generation timing A4 in FIG. 4C.

More specifically, according to the first embodiment, the accompaniment data creation process of block 26 comprises including, into the arranged accompaniment data, one or more accompaniment notes present at time positions away from the extracted one or more accent positions by a predetermined length or more (e.g., by one beat or more) among the one or more accompaniment notes generated on the basis of the acquired accompaniment pattern data. In this way, it is possible to make an arrangement with characteristics of the user-selected existing accompaniment pattern data still remaining therein. Example accompaniment notes with characteristics of the user-selected existing accompaniment pattern data still remaining therein are accompaniment notes at tone generation timings A1, A2, A5, A6 and A7 shown in later-described FIG. 4C.

Figures 3A, 3B:
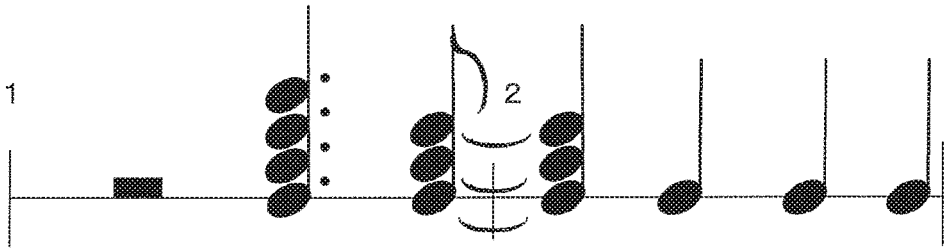

The following describe, with reference to FIGS. 3 and 4, specific examples of the processes of blocks 24 to 27 above pertaining to the first embodiment. FIGS. 3A and 3B show example results of the accent position extraction performed in block 24 with regard to first and second measures of given original performance information. More specifically, FIG. 3A is a diagram showing an example rhythm image of the first and second measures of the original performance information, and FIG. 3B is a table showing accent positions extracted from the original performance information having the rhythm image shown in FIG. 3A. More specifically, FIG. 3B shows an example result of the accent position extraction performed in accordance with the technique described in item (1) above, i.e. the technique where the number of notes to be sounded simultaneously is determined per tone generation timing of chord and melody parts in the original performance information.

In FIG. 3B, a "MEASURE NO." column indicates measure numbers in the original performance information, of which "1" and "2" indicate the first and second measures, respectively. A "BEAT NO." column indicates beat numbers in a measure, of which "1", "2", "3" and "4" indicate first, second, third and fourth beats, respectively. Let it be assumed here that the music piece represented by the original performance information is in four-four time. A "POSITIONAL DIFFERENCE" column indicates a difference of a position of a note in the original performance information from a beat position by the number of clock ticks (or pulses) with the assumption that the length (duration) of a quarter note equals 480 clock ticks. More specifically, positional difference "0" indicates that the note (i.e., tone generation timing of the note) is located at the beat position, positional difference "240" indicates that the note (tone generation timing of the note) is located at a position away or displaced from the beat position by the length of an eighth note. Further, a "NUMBER OF NOTES" column indicates the number of notes to be sounded simultaneously per tone generation timing. A "LENGTH" column indicates a length of the notes to be sounded per tone generation timing. Further, "EIGHTH NOTE+QUARTER NOTE" in the "LENGTH" column indicates that an eighth note at the end of the first measure and a quarter note at the beginning of the second measure are interconnected by syncopation. Furthermore, an "ACCENT" column indicates whether or not the note has been extracted as an accent position; namely, "A" indicates that the note has been extracted as an accent position, where "–" indicates that the tone generation timing has not been extracted as an accent position. In the illustrated example of FIG. 3, let it be assumed that a threshold value of the number of notes to be extracted as an accent position is set at "3". Specifically, in the illustrated example of FIG. 3, the tone generation timing of a dotted quarter note length at the third beat of the first measure and the tone generation timing of an "EIGHTH NOTE+QUARTER NOTE" length running from the off-beat of the fourth beat of the first measure to the first beat of the second measure by syncopation is extracted as accent positions.

Figure 4A:
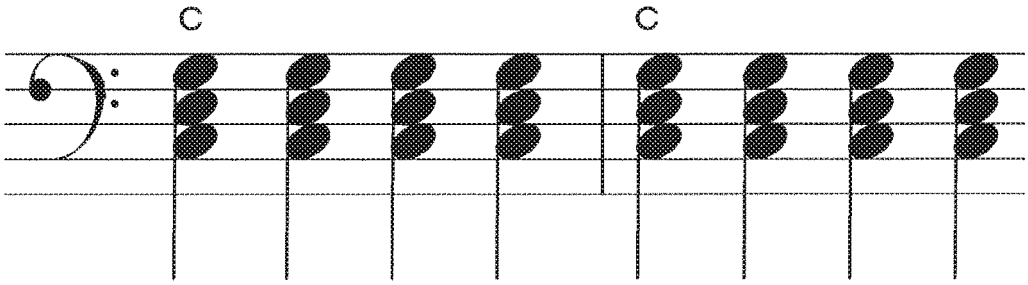
Figure 4B:
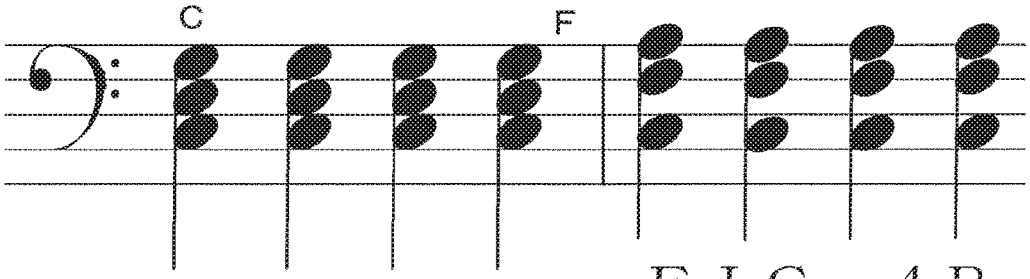

FIG. 4A shows a musical score representative of an example of accompaniment pattern data (template) acquired in block 25 above. The accompaniment pattern data represents a chord backing pattern where C major chords, each having a quarter note length, are regularly placed in succession. As conventionally known in the art, the accompaniment pattern data (template) has a reference key or root predefined therein; in the illustrated example of FIG. 4A, the predefined reference key or root is "C". FIG. 4B shows an example of chord information acquired in block 21 above and a musical score representative of an example where accompaniment notes to be generated on the basis of the accompaniment pattern data of FIG. 4A have been shifted in pitch in accordance with the acquired chord information. In the illustrated example of FIG. 4B, C major chords are notated or placed successively from the first beat to the on-beat (eighth note length) of the fourth beat of the first measure, and F major chords are notated or placed successively from the off-beat (eighth note length) of the fourth beat of the first measure to the end of the second measure. Namely, in the illustrated example of FIG. 4B, pitches of the chord backing pattern of the second measure are shifted to the F major chord in accordance with (i.e., reflecting) the chords of the original performance information.

Figure 4C:
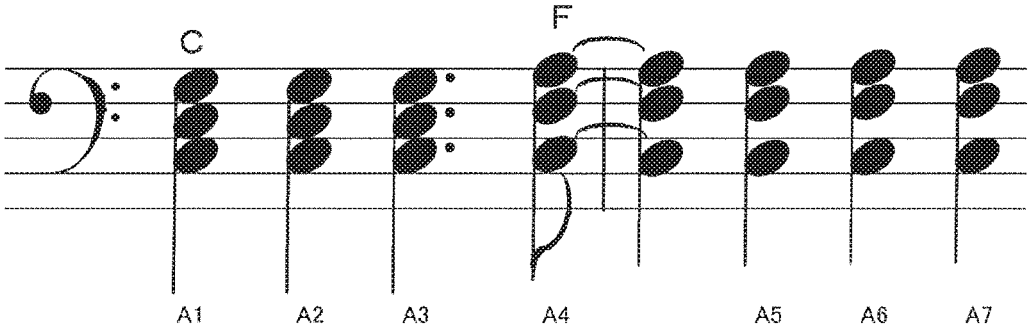

FIG. 4C shows a musical score indicative of a result of the accompaniment data creation performed in block 26 above, which more particularly shows an example where the accompaniment notes shown in FIG. 4B have been adjusted in accent position in accordance with the result of the accent position extraction shown in FIG. 3B. Because there is an accent (rhythmic accent) of a dotted quarter note length (rhythmic accent) at the third beat of the first measure, the tone generation timing of the C major chord of the quarter note length at the third beat of the first measure in FIG. 4B is changed to the dotted quarter note length as indicated by tone generation timing A3 in FIG. 4C. Further, because there is an accent (rhythmic accent) of syncopation of an (eighth note+quarter note) length at the off-beat (eighth note length) of the fourth beat of the first measure, the tone generation timing of the C major chord of the quarter note length at the fourth beat of the first measure in FIG. 4B is shifted to the time position of the off-beat (eighth note length) as indicated by tone generation timing A4 in FIG. 4C but also changed to syncopation of the (eighth note+quarter note) length running or lasting to the first beat of the second measure. Also, the chord to be sounded at tone generation timing A4 is shifted in pitch to the F major chord in response to a shift from the off-beat (eighth note length) of the fourth beat of the first measure to the F major chord. Because tone generation timings A1, A2, A5, A6 and A7 are away from the accent positions by predetermined lengths or over (e.g., by one beat or over) in FIG. 4C, the chord sounding timings in the accompaniment pattern data (template) are maintained without being influenced by the adjustment based on the accent positions.

The processes shown in FIGS. 3A to 4C are performed on all of the necessary measures rather than only on the first and second measures. Thus, in block 26, arranged accompaniment data are created for all of the necessary measures.

Figure 5:
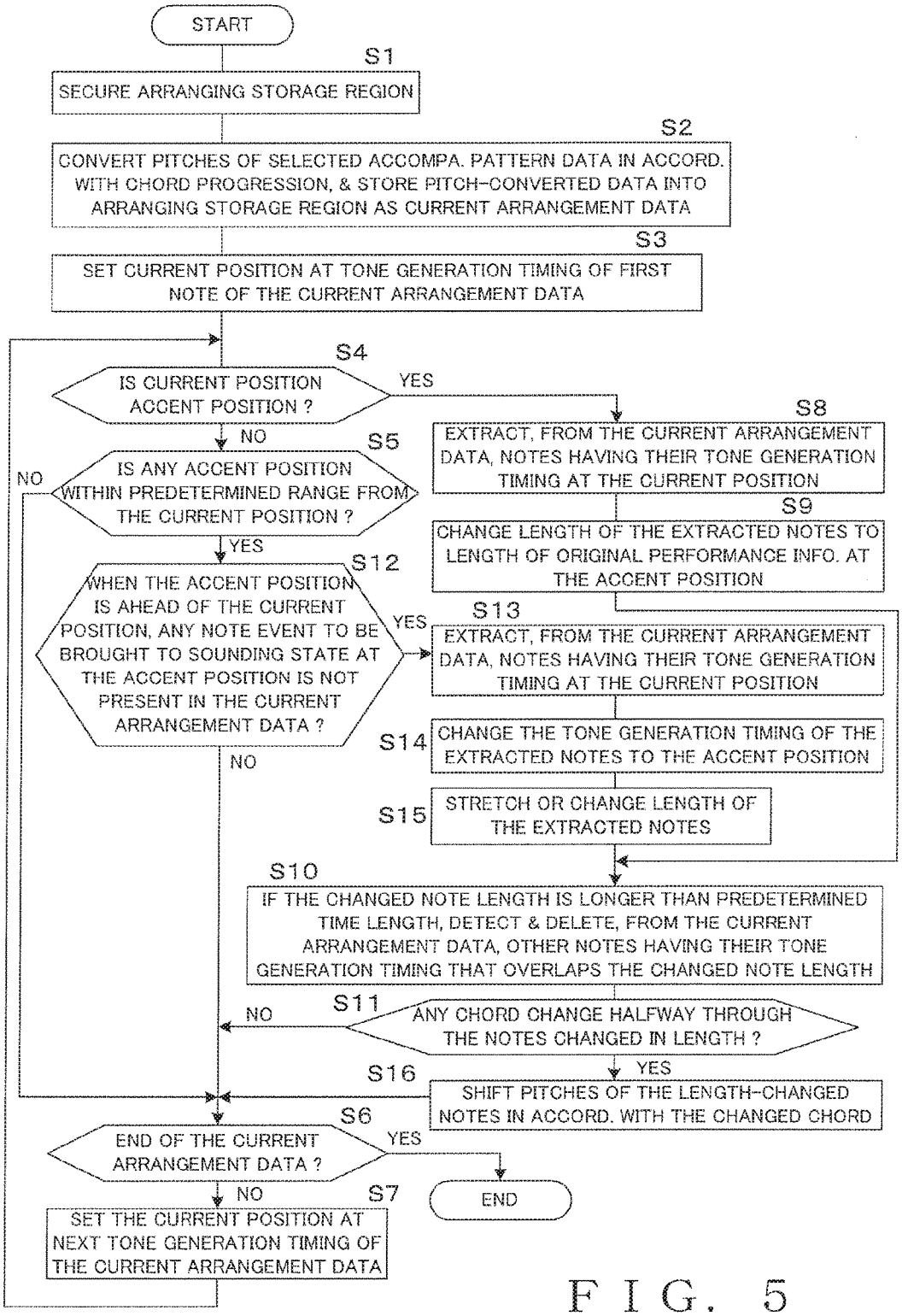
FIG. 5 is a flow chart showing a specific example of a process (arrangement process) performed as a first embodiment of an accompaniment data creation process in the embodiment of FIG. 2 for creating accompaniment data.

Next, with reference to FIG. 5, a description will be given about a specific operational sequence of a first embodiment of the process (arrangement process) performed in block 26 as a first embodiment of the accompaniment data creation process. At step S1 in FIG. 5, an arranging storage region is set within the RAM 3. At next step S2, placement of accompaniment pattern data selected by the user in block 25 above (see, for example, FIG. 4A) is repeated for a length of a portion of the music piece where the accompaniment data are to be used. Also, at step S2, pitches of accompaniment notes based on the accompaniment pattern data are converted or shifted in accordance with a chord progression of the original performance information (see, for example, FIG. 4B), and accompaniment data of the thus pitch converted accompaniment notes are stored into the arranging storage region. The data of the pitch-converted accompaniment notes thus stored in the arranging storage region will hereinafter be referred to as "current arrangement data". At next step S3, a current position for this arrangement process is set at the tone generation timing of the first note of the current arrangement data stored in the arranging storage region.

At next step S4, a determination is made, with reference to the result of the accent position extraction performed in block 24 above (see, for example, FIG. 3B), as to whether or not the above-mentioned current position is an accent position. With a negative or NO determination at step S4, the process proceeds to step S5, where a further determination is made as to whether or not any accent position is present within a predetermined range (e.g., a quarter note length or less) from the above-mentioned current position. With a NO determination at step S5, the process goes to step S6, where a further determination is made as to whether or not the process has been performed up to the end of the current arrangement data stored in the arranging storage region. If the process not has been performed up to the end of the current arrangement data as determined at step S6, the process proceeds to step S7, where the tone generation timing of the next note in the current arrangement data is set as the current position. After step S7, the process reverts to step S4. The processing on tone generation timings A1 and A2 in FIG. 4C is performed along a predetermined route where it proceeds to step S7 by way of NO determinations at steps S4, S5 and S6 and then reverts to step S4.

If the current position for the arrangement process is an accent position like tone generation timing A3 in FIG. 4C, a YES determination is made at step S4, so that the process goes to step S8. At step S8, notes (a note group) having their tone generation timing at the current position are extracted from the current arrangement data stored in the arranging storage region. At tone generation timing A3 in FIG. 4C, for example, a note group constituting the C major chord is extracted from the current arrangement data. At next step S9, the length of the extracted note group is changed to a note length, at the accent position, of the original performance information. Thus, the length of the notes at tone generation timing A3 in FIG. 4C is changed to the dotted quarter note length. In the aforementioned manner, the length of the notes corresponding to the accent position in the current arrangement data stored in the arranging storage region is adjusted to match a rhythmic accent of the original performance information.

At step S10, if the note length changed as above is longer than a predetermined time length, other notes (other note group) having their tone generation timing that overlaps the changed note length are detected from the current arrangement data, and the thus-detected notes (other note group) are deleted from the current arrangement data. The above-mentioned predetermined time length can be set as appropriate by the user and may be an eighth note length, quarter note length, or the like. The longer the predetermined time length is set, the stronger an accent feel possessed by the original performance having a long duration would be reflected in the arranged accompaniment data. Conversely, the shorter the predetermined time length is set, the lower would become the probability of notes being deleted from the current arrangement data, so that a beat feel possessed by the accompaniment pattern data can be maintained more easily. Assuming that the predetermined time length is set at a quarter note length, when the length of the note group at the third beat of the first measure in FIG. 4B has been changed to a dotted quarter note length as indicated at tone generation timing A3 in FIG. 4C, the process goes to step S10, where it is determined that the length of the note group at the third beat of the first measure has been changed to a note length longer than the abovementioned predetermined time length, and thus, the note group at the fourth beat of the first measure in FIG. 4B is detected as notes having their tone generation timing overlapping the changed note length and deleted from the current arrangement data.

Then, at step S11, a determination is made as to whether or not there has been any chord change halfway through the notes (note group) having been changed in note length as noted above. For the notes (note group) having been changed to the dotted quarter note length at tone generation timing A3 in FIG. 4C, no chord change has been made halfway therethrough, and thus, a NO determination is made at step S11, so that the process jumps to step S6 and then reverts to step S4 by way of step S7. Because the note group at the fourth beat of the first measure in FIG. 4B has already been deleted, the next tone generation timing in the current arrangement data is the first beat of the second measure in FIG. 4B. Thus, at step S4, it is determined that the current position (first beat of the second measure) does not coincide with an accent position.

With a NO determination at step S4, the process proceeds to step S5, where a further determination is made as to whether any accent position is present within a predetermined range (e.g., a quarter note length or less) from the above-mentioned current position. If the first beat of the second measure in FIG. 4B is the current position, a YES determination is made at step S5 because a position ahead of (i.e., temporally preceding) the current position by an eighth note length has been extracted as an accent position (see FIG. 3), so that the process proceeds to step S12. At step S12, when the accent position in question is temporally ahead of (or temporally precedes) the current position, a determination is made as to whether any note event to be brought to a sounding (tone generating state) state at the accent position is not present in the current arrangement data. If the first beat of the second measure in FIG. 4B is the current position, a YES determination is made at step S12 because no note event is present in the current arranged data at the accent position ahead of the current position by an eighth note length, so that the process goes to step S13.

At step S13, notes (a note group) having their tone generation timing at the current position are extracted from the current arrangement data. In the aforementioned case, the component notes of the F major chord at the first beat of the second measure in FIG. 4B are extracted from the current arrangement data. At following step S14, the tone generation timing of the notes (note group) extracted at preceding step S13 is changed to the accent position in question. At next step S15, the length of the notes (note group) (note length) changed to the accent position at preceding step S14 is stretched or changed (adjusted). As an example, in response to the tone generation timing of the notes (note group) extracted at preceding step S14 having been changed to the temporally preceding accent position, the note length is stretched by an amount corresponding to the change, to the accent position, of the tone generation timing of the notes (note group). For example, as shown at timing A4 in FIG. 4C, the note length is stretched in such a manner as to provide syncopation of the "eighth note+ quarter note" length spanning from the off-beat (eighth note length) of the fourth beat of the first measure to the first beat of the second measure.

Following step S15, the process proceeds to steps S10 and S11. Note that, in the case where a chord change has been made halfway through the notes (note group) changed in note length as above, the process goes to step S16 by way of a YES determination at step S11. At step S16, the notes (note group) changed in note length are converted or shifted in pitch in accordance with the changed chord.

With the above-described first embodiment, it is possible to automatically create accompaniment data with accent positions (rhythmic accents) possessed by original performance information taken into consideration, and thereby achieve a good-quality automatic arrangement.

<Second Embodiment>

Next, another specific example of the process in block 26 above will hereinafter be described as a second embodiment of the accompaniment data creation process. The second embodiment is designed to not include, into arranged accompaniment data, accompaniment notes that do not coincide with the extracted accent positions, as a general rule. Additionally, if any accompaniment note in the accompaniment pattern data is located at a time position finer than a predetermined note resolution, the second embodiment does not include such an accompaniment note into arranged accompaniment data unless the time position of the accompaniment note in question coincides with any one of the extracted accent positions. Namely, the second embodiment is designed in such a manner 1) that, if, of one or more accompaniment notes to be generated on the basis of the acquired accompaniment pattern data, any one accompaniment note located at a time position finer than the predetermined note resolution coincides with one of the extracted accent positions, that one accompaniment note located at the finer time position is included into the arranged accompaniment data, and 2) that, if, of one or more accompaniment notes to be generated on the basis of the acquired accompaniment pattern data, any one accompaniment note located at a time position finer than the predetermined note resolution coincides with none of the extracted accent positions, that one accompaniment note located at the finer time position is not included into the arranged accompaniment data. The predetermined note resolution can be set as desired by the user and may be a resolution of a quarter note, eighth note or the like.

Figures 6A, 6B:
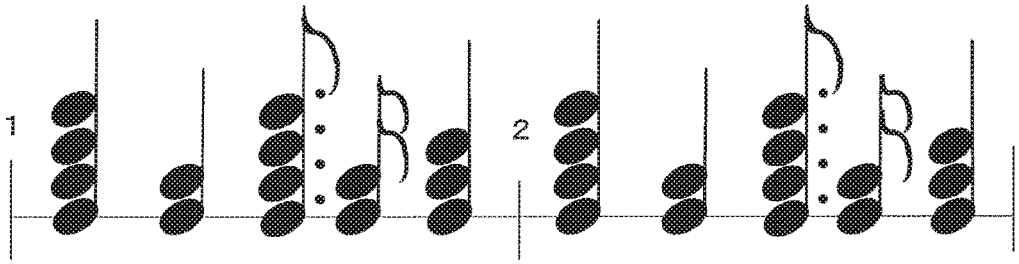

The following describe, with reference to FIGS. 6A to 7C, specific examples of the processes of blocks 24 to 27 pertaining to the second embodiment. Like FIGS. 3A and 3B, FIGS. 6A and 6B are diagrams showing example results of the accent position extraction performed in block 24 above with regard to first and second measures in given original performance information. More specifically, FIG. 6A is a diagram showing an example rhythm image of the first and second measures of the original performance information, and FIG. 6B is a table showing accent positions extracted from the original performance information having the rhythm image shown in FIG. 6A. The way of viewing the table shown in FIG. 6B is the same as the way of viewing FIG. 3B. However, because the original performance information of FIG. 6B is different from the original performance information of FIG. 3B, the results of the accent position extraction shown in FIGS. 3B and 6B are different from each other.

Figure 7A:
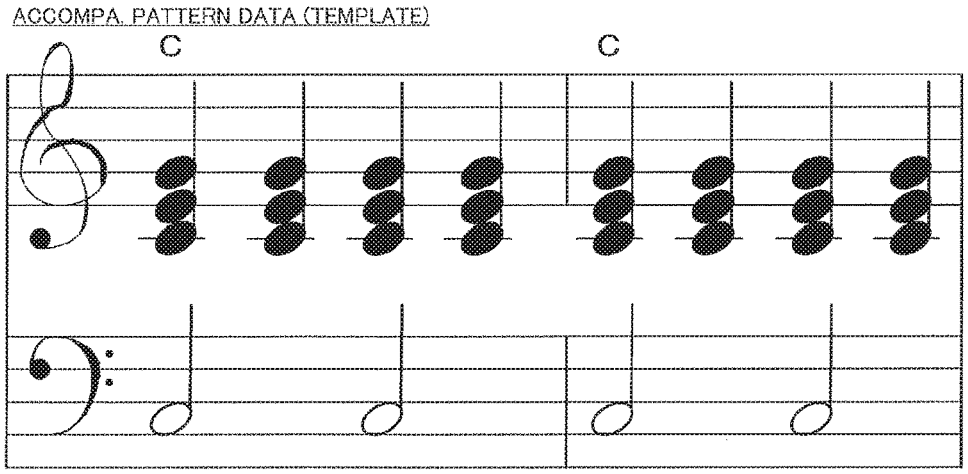
Figure 7B:
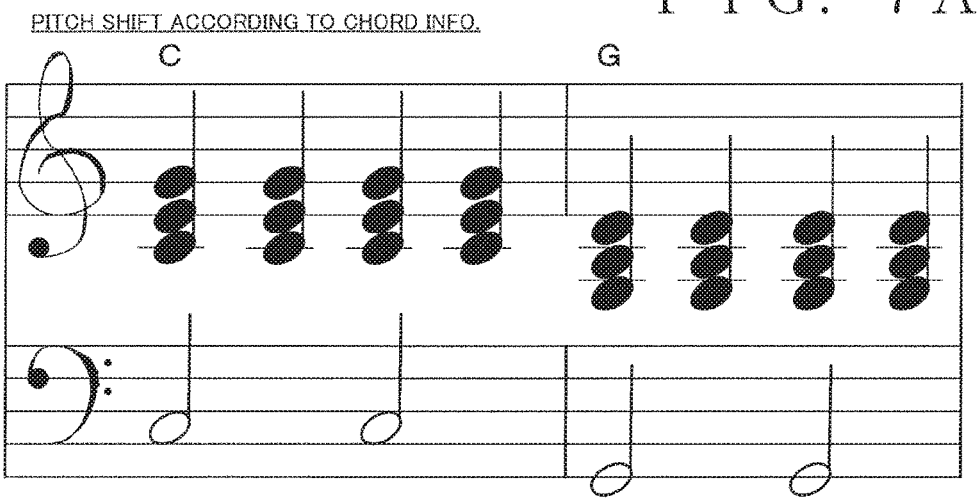

Further, FIG. 7A shows a musical score representative of an example of accompaniment pattern data (template) acquired in block 25 above in the second embodiment. The accompaniment pattern data comprises a combination of a chord backing pattern where C major chords, each having a quarter note length, are recorded in succession regularly, and a bass pattern. FIG. 7B shows an example of chord information acquired in block 21 above in the second embodiment and a musical score representative of an example where accompaniment notes (chord notes and bass notes) to be generated on the basis of the accompaniment pattern data of FIG. 7A have been shifted in pitch in accordance with the acquired chord information through the process of block 27. In the illustrated example of FIG. 7B, C major and G major chords are notated in the first measure and second measure, respectively, of the original performance information. Thus, in the illustrated example of FIG. 7B, the pitches of each of the chords of the second measure are shifted in pitch to the G major chord and the bass tones are also shifted in pitch, reflecting the chords of the original performance information.

Figure 7C:
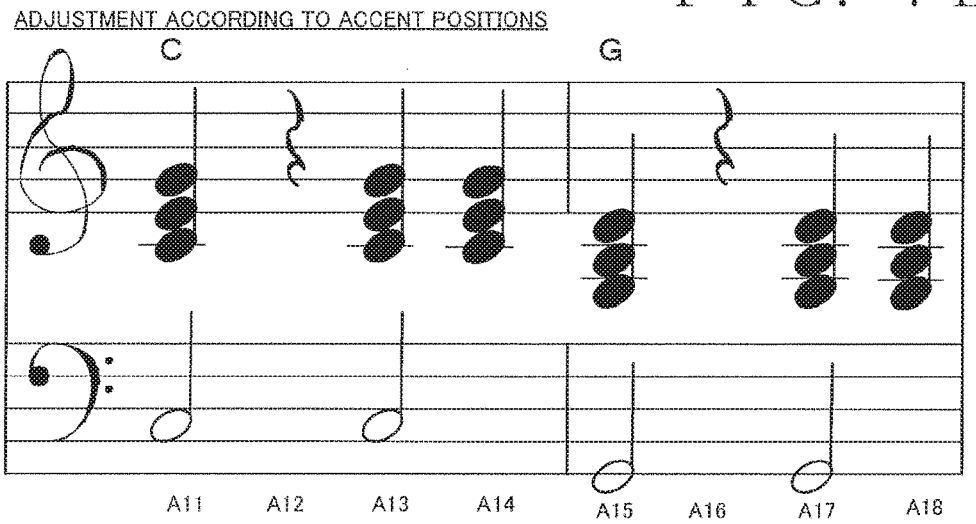

FIG. 7C shows a musical score indicative of a result of the accompaniment data creation process performed in block 26 above, which more particularly shows an example where accent positions of the accompaniment notes shown in FIG. 7B have been adjusted in accordance with the accent position extraction result shown in FIG. 6. Let it be assumed here that the above-mentioned predetermined note resolution is set at an eighth note resolution. No note of a finer note resolution than the eighth note resolution is originally present in the accompaniment pattern data (template) shown in FIG. 7A, and thus, in the illustrated example, there appears no operations, noted in items 1 and 2) above, for including into the arranged accompaniment data an accompaniment note located at a time position than the predetermined note resolution if the accompaniment note coincides with an accent position and not including into the arranged accompaniment data an accompaniment note located at a time position than the predetermined note resolution if the accompaniment note does not coincide with an accent position. Further, because the number of notes at the first, third and fourth beats of the first measure and at the first, third and fourth beats of the second measure in the original performance information is "4" or "3" as shown in FIG. 6B, these beats are extracted as accent positions in accordance with the threshold value "3". On the other hand, because the number of notes at the second beat of the first measure and at the second beat of the second measure in the original performance information is "2", these beats are not extracted as accent positions. Thus, chords at the second beats (tone generation timings A12 and A16) of the first and second measures in the original accompaniment pattern data have been deleted in created accompaniment data, as shown in FIG. 7C.

Figure 8:
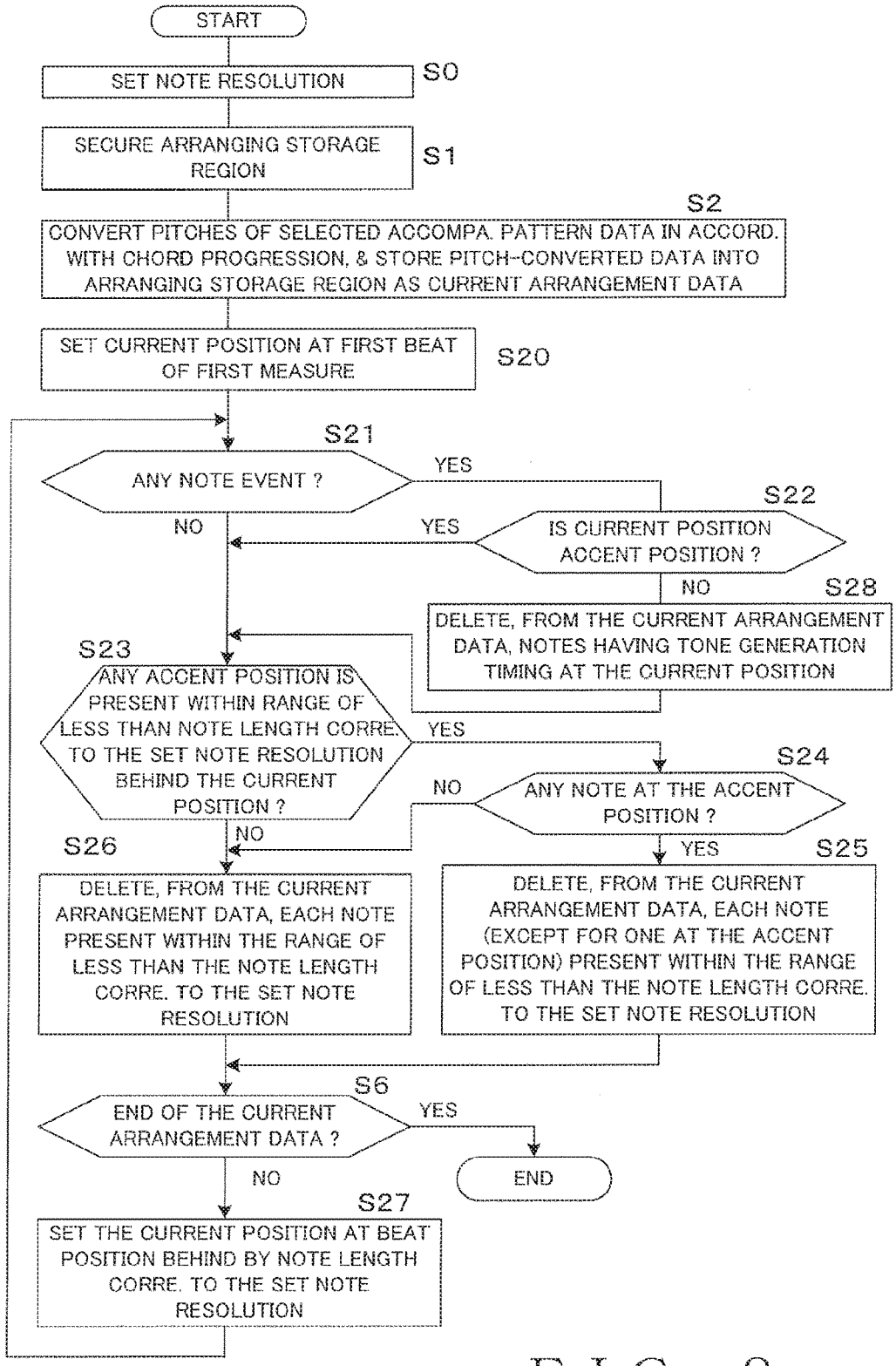
FIG. 8 is a flow chart showing a specific example of the process (arrangement process) performed as a second embodiment of the accompaniment data creation process in the embodiment of FIG. 2 for creating accompaniment data.

Next, with reference to FIG. 8, a description will be given about a specific operational sequence of the process (arrangement process) performed in block 26 above as a second embodiment of the accompaniment data creation process. At step S0 in FIG. 8, a note resolution to be used for the arrangement process is set in accordance with a user's selection. Let it be assumed here that the note resolution is set at a resolution of an eighth note length. At steps S1 and S2 in FIG. 8 are performed operations similar to those of the same reference characters (S1 and S2) in FIG. 5. For example, placement of accompaniment pattern data as shown in FIG. 7A is repeated a plurality of times corresponding to a length of a portion of the music piece where the accompaniment pattern data is to be used, and the thus-repeated accompaniment pattern data is stored as current arrangement data into the arranging storage region. This current arrangement data is shifted to pitches as shown in FIG. 7B in accordance with chord information. At next step S20, the current position for the arrangement process is set at the first beat of the first measure of the current arrangement data stored in the arranging storage region.

At next step S21, a determination is made as to whether or not any note event is present at the current position of the current arrangement data. In the illustrated example of FIG. 7B, when the current position is the first beat of the first measure, a YES determination is made at step S21 because there is a note event at the current position, so that the process proceeds to step S22. At step S22, a further determination is made as to whether the current position is an accent position. In the illustrated example of FIG. 6, a YES determination is made at step S22 because the first beat of the first measure is an accent position, so that the process goes to step S23.

At step S23, a further determination is made as to whether any accent position of the original performance information is present within a range of less than a note length corresponding to the set note resolution (e.g., less than an eighth note length) behind (i.e., following) the current position. If an accent position is present at a position behind the current position by a sixteenth note length, a YES determination is made at step S23, so that the process goes to step S24. At step S24, a further determination is made as to whether the current arrangement data has any note event present at that accent position. With a YES determination at step S24, the process proceeds to step S25, where each note, except for the note at that accent position, present within the range of less than the note length corresponding to the set note resolution behind the current position is deleted from the current arrangement data.

If no accent position of the original performance information is present within the range of less than the note length corresponding to the set note resolution (e.g., less than an eight note length), or if no note event is present at the accent position in the current arrangement data even though an accent position of the original performance information is present within the range, the process goes to step S26. At step S26, each note present within the range of less than the note length corresponding to the set note resolution behind the current position is deleted from the current arrangement data.

Namely, at steps S23 to S26 above, the process is performed in such a manner 1) that, if, of one or more accompaniment notes to be generated on the basis of the acquired accompaniment pattern data, any one accompaniment note located at a time position finer than the predetermined note resolution and coinciding with one of the extracted accent positions is included into the arranged accompaniment data, and 2) that, if, of one or more accompaniment notes to be generated on the basis of the acquired accompaniment pattern data, any one accompaniment note located at a time position finer than the predetermined note resolution but coinciding with none of the extracted accent positions is not included into the arranged accompaniment data.

Following step S26, the process goes to step S6, where a determination is made as to whether the process has been performed up to the end of the current arrangement data stored in the arranging storage region. If the process has not been performed up to the end of the current arrangement data as determined at step S6, the process proceeds to step S27, where the current position is set at a beat position (e.g., the off-beat of the first beat) behind (following) the current position by the note length (e.g., eighth note length) corresponding to the set note resolution. Following step S27, the process reverts to step S21.

In the illustrated examples of FIGS. 6B and 7B, when the current position is the first beat of the first measure, there is a note event at the current position, and the current position is an accent position; thus, the process goes to step S27 by way of a YES determination at step S22 and NO determinations at steps S23, S26 and S6. Consequently, the notes (note group) at the first beat of the first measure in the current arrangement data are left without being deleted, so that the notes (note group) at the first beat of the first measure are included into the arranged accompaniment data as indicated at tone generation timing A11 in FIG. 7C.

Further, in the illustrated examples of FIGS. 6B and 7B, when the current position is the off-beat of the first beat of the first measure, there is no note event at the current position; thus, the process goes to step S27 by way of NO determinations at steps S21, S23, S26 and S6. Thus, in this case, the current position is set at the second beat (on-beat) of the first measure.

Further, in the illustrated examples of FIGS. 6B and 7B, when the current position is the second beat (on-beat) of the first measure, there is a note event at the current position, but the current position is an accent position; thus, a NO determination is made at step S22, so that the process goes to step S28. At step S28, the notes having their tone generation timing at the current position are deleted from the current arrangement data. In this manner, the notes (note group) at the second beat (on-beat) of the first measure in the current arrange data are deleted, so that these notes are not included into the arranged accompaniment data as indicated at tone generation timing A12 in FIG. 7C.

Following step S28, the process goes to step S23 so as to repeat the aforementioned operations. At and after step S23 in the illustrated examples of FIGS. 6B and 7B, because the accompaniment pattern data has note events at the third and fourth beats of the first measure and at the first, third and fourth beats of the second measure and these beats coincide with accent positions of the original performance information, accompaniment note data of these beats are left in the current arrangement data, and the notes (note groups) at these beats are included into the arranged accompaniment data as indicated at tone generation timings A13, A14, A15, A17 and A18 in FIG. 7C. Further, because the second beat of the second measure, on the other hand, is not an accent position although a note event is present at the second beat, so that accompaniment note data of the second beat of the second measure is deleted from the current arrangement data and thus is not included into the arranged accompaniment data as indicated at tone generation timing A16 in FIG. 7C.

The above-described second embodiment, like the first embodiment, can automatically create accompaniment data with accent positions (rhythmic accents) possessed by original performance information taken into consideration and thereby make a good-quality automatic arrangement. Further, because the second embodiment is designed in such a manner that each accompaniment note of a resolution finer than the predetermined note resolution is omitted from the arranged accompaniment data unless the accompaniment note corresponds to any one of the accent positions, it can provide an arrangement easy even for a beginner human player to perform.

Each of the above-described embodiments of the present invention is constructed to determine strong accent positions in a music piece represented by original performance information and adjust time positions of accompaniment notes in accordance with the strong accent positions. However, the present invention is not so limited, and one or more weak accent positions in a music piece represented by original performance information may be determined so as to adjust time positions of accompaniment notes in accordance with the weak accent positions. For example, a determination may be made, on the basis of acquired original performance information, as to whether the current time point coincides with a weak accent position in the music piece. In such a case, when it has been determined that the current time point coincides with a particular weak accent position, arranged accompaniment data may be created by adjusting the time position of one or more accompaniment notes, which are to be generated on the basis of acquired accompaniment pattern data, so as to coincide with the particular weak accent position. In this way, the present invention can arrange the music piece in such a manner that an accompaniment performance presents weak accents in conformity to one or more weak accent positions in the music piece represented by the original performance information.

This application is based on, and claims priority to, JP PA 2015-185299 filed on 18 Sep. 2015. The disclosure of the priority application, in its entirety, including the drawings, claims, and the specification thereof, are incorporated herein by reference.

What is claimed is:

1. An automatic arrangement apparatus comprising:

a memory storing instructions; and a processor configured to implement the instructions and execute a plurality of tasks, including:

a first acquiring task that acquires original performance information;

a generating task that generates encoded data of individual notes constituting the acquired original performance information, the encoded data of individual notes identifying at least time positions and note values;

an extracting task that extracts, from the encoded data of individual notes constituting the acquired original performance information, at least one accent position in a music piece represented by the acquired original performance information, the at least one extracted accent position identifying at least one time position and at least one note value of at least one note corresponding to the at least one extracted accent position;

a second acquiring task that acquires existing accompaniment pattern data, which includes accompaniment notes; and a creating task that creates arranged accompaniment data by adjusting at least one time position and at least one note value of the acquired accompaniment notes, in accordance with the at least one time position and at least one note value identified by the at least one extracted accent position, wherein the extracting task, for extraction of the at least one accent position, obtains a number of notes to be sounded simultaneously per tone generation timing in the acquired original performance information, and extracts, as an accent position, each tone generation timing where the number of notes to be sounded simultaneously is equal to or greater than a predetermined threshold value.

2. The automatic arrangement apparatus as claimed in claim 1, wherein the creating task:

in a case where the acquired accompaniment notes include one accompaniment note present at a time position coinciding with one accent position, among the at least one extracted accent position, arranges the arranged accompaniment data with the one accompaniment note coinciding with the one accent position; or in a case where the acquired accompaniment notes include no accompaniment note present at a time position coinciding with one accent position, among the at least one extracted accent position, shifts an accompaniment note, among the acquired accompaniment notes, present at a time position nearest the one accent position over to another time position coinciding with the one accent position and includes the shifted accompaniment note in the arranged accompaniment data.

3. The automatic arrangement apparatus as claimed in claim 1, wherein the creating task includes, in the arranged accompaniment data, an accompaniment note, among the acquired accompaniment notes, present at a time position away from one accent position, among the at least one extracted accent position.

4. The automatic arrangement apparatus as claimed in claim 1, wherein the creating task:

in a case where the acquired accompaniment notes include one accompaniment note located at a finer time position than a predetermined note resolution coinciding with one accent position, among the at least one extracted accent position, includes, in the arranged accompaniment data, the one accompaniment note located at the finer time position; and in a case where the acquired accompaniment notes include one accompaniment note located at a finer time position than the predetermined note resolution coinciding with none of the at least one extracted accent position, does not include, in the arranged accompaniment data, the one accompaniment note located at the finer time position.

5. The automatic arrangement apparatus as claimed in claim 1, wherein the extracting task extracts, from the acquired original performance information:

performance information of at least one part including a melody part; and the at least one accent position based on the extracted performance information of the at least one part.

6. The automatic arrangement apparatus as claimed in claim 1, wherein:

the extracting task separates and extracts performance information of a particular part from the acquired original performance information, and the plurality of tasks include a synthesizing task that synthesizes the extracted performance information of the particular part with the created arranged accompaniment data.

7. The automatic arrangement apparatus as claimed in claim 1, wherein:

the acquired original performance information includes an accent mark to be indicated on a musical score, and the extracting task, for extraction of the at least one accent position, also extracts, as an accent position, a tone generation timing corresponding to the accent mark included in the acquired original performance information.

8. The automatic arrangement apparatus as claimed in claim 1, wherein the extracting task, for extraction of the at least one accent position, also extracts, as an accent position, a tone generation timing of each note event whose velocity value is equal to or greater than a predetermined threshold value from among note events included in the acquired original performance information.

9. The automatic arrangement apparatus as claimed in claim 1, wherein:

the acquired original performance information represents a music piece comprising a plurality of portions, and the extracting task, for extraction of the at least one accent position, also extracts, based on at least one of positions or pitches of a plurality of notes in one of the plurality of portions in the original performance information, an accent position in the one of the plurality of portions.

10. The automatic arrangement apparatus as claimed in claim 1, wherein the extracting task, for extraction of the at least one accent position, also extracts, as an accent position, a tone generation timing of a note whose pitch changes from a pitch of a preceding note greatly, by a predetermined threshold value or more, to a higher pitch or a lower pitch in a temporal pitch progression in the acquired original performance information.

11. The automatic arrangement apparatus as claimed in claim 1, wherein the extracting task, for extraction of the at least one accent position, weighs each note in the acquired original performance information with a beat position, in a measure, of the note taken into consideration and also extracts, as an accent position, a tone generation timing of each of the notes whose weighed value is equal to or greater than another predetermined threshold value.

12. The automatic arrangement apparatus as claimed in claim 1, wherein the extracting task, for extraction of the at least one accent position, weighs a note value of each note in the acquired original performance information and also extracts, as an accent position, a tone generation timing of each of the notes whose weighed value is equal to or greater than another predetermined threshold value.

13. The automatic arrangement apparatus as claimed in claim 1, wherein:

the plurality of tasks include a determining task that determines at least one weak accent position in a music piece represented by the original performance information, and the creating task creates the arranged accompaniment data by further arranging at least one time position of the acquired accompaniment notes to coincide with the determined at least one weak accent position.

14. The automatic arrangement apparatus as claimed in claim 1, wherein the creating task, for creation of the arranged accompaniment data:

creates accompaniment data of a given portion of the music piece by placing, in the given portion of the music piece, the acquired accompaniment pattern data once or repeatedly a plurality of times; and creates the arranged accompaniment data having at least a length of the given portion by arranging a time position of at least one accompaniment note in the given portion to coincide with at least one of the at least one extracted accent position.

15. An automatic arrangement method implemented with a processor, the method comprising:

a first acquiring step of acquiring original performance information;

a generating step of generating encoded data of individual notes constituting the acquired original performance information, the encoded data of individual notes identifying at least time positions and note values;

an extracting step of extracting, from the encoded data of individual notes constituting the acquired original performance information, at least one accent position in a music piece represented by the acquired original performance information, the at least one extracted accent position identifying at least one time position and at least one note value of at least one note corresponding to the at least one extracted accent position;

a second acquiring step of acquiring existing accompaniment pattern data, which includes accompaniment notes; and a creating step of creating arranged accompaniment data by adjusting at least one time position and at least one note value of the acquired accompaniment notes, in accordance with at least one time position and at least one note value identified by the at least one extracted accent position, wherein the extracting step, for extraction of the at least one accent position, obtains a number of notes to be sounded simultaneously per tone generation timing in the acquired original performance information, and extracts, as an accent position, each tone generation timing where the number of notes to be sounded simultaneously is equal to or greater than a predetermined threshold value.

16. A non-transitory machine-readable storage medium containing a program executable by a processor to perform an automatic arrangement method comprising:

a first acquiring step of acquiring original performance information;

a generating step of generating encoded data of individual notes constituting the acquired original performance information, the encoded data of individual notes identifying at least time positions and note values;

an extracting step of extracting, from the encoded data of individual notes constituting the acquired original performance information, at least one accent position in a music piece represented by the acquired original performance information, the at least one extracted accent position identifying at least one time position and at least one note value of at least one note corresponding to the at least one extracted accent position;

a second acquiring step of acquiring existing accompaniment pattern data, which includes accompaniment notes; and a creating step of creating arranged accompaniment data by adjusting at least one time position and at least one note value of the acquired accompaniment notes in accordance with at least one time position and at least one note value identified by the at least one extracted accent position, wherein the extracting step, for extraction of the at least one accent position, obtains a number of notes to be sounded simultaneously per tone generation timing in the acquired original performance information, and extracts, as an accent position, each tone generation timing where the number of notes to be sounded simultaneously is equal to or greater than a predetermined threshold value.

* * * * *